United States Patent [19]

Epstein et al.

[11] 4,111,253

[45] Sep. 5, 1978

[54] FOUNDRY PROCESSES AND COMPOSITIONS

[75] Inventors: David Epstein; John Bugg, both of London, England

[73] Assignee: The White Sea & Baltic Company Limited, London, England

[21] Appl. No.: 761,756

[22] Filed: Jan. 24, 1977

Related U.S. Application Data

[63] Continuation-in-part of Ser. No. 282,633, Aug. 21, 1972, abandoned.

[51] Int. Cl.[2] ..... B22C 1/22

[52] U.S. Cl. ..... 164/43; 260/29.3; 260/29.4 R; 260/38; 260/39 SB; 260/DIG. 40

[58] Field of Search ..... 260/29.3, 29.4 R, 38, 260/39 SB, DIG. 40; 164/43

[56] References Cited

U.S. PATENT DOCUMENTS

| | | | |
|---|---|---|---|
| 3,424,600 | 1/1969 | Liass et al. | 106/38.35 |
| 3,720,642 | 3/1973 | Junger et al. | 260/38 |
| 3,734,936 | 5/1973 | Brown et al. | 260/39 SB |

FOREIGN PATENT DOCUMENTS 1,430,841 7/1976 United Kingdom.

*Primary Examiner*—Lorenzo B. Hayes
*Attorney, Agent, or Firm*—Lawrence Rosen; E. Janet Berry

[57] ABSTRACT

Improved method for making foundry moulds and cores involves use of composition having foamed aqueous phase and comprising foundry sand, resin, curing agent for resin, silane, a low amount of water and a foaming agent such that the foam persists until the composition sets. Preferred features reside in having a total water content of from about 1% to about 2%, in using sodium lauryl ether sulphate as the foaming agent and in the order of mixing the ingredients.

9 Claims, No Drawings

FOUNDRY PROCESSES AND COMPOSITIONS

This application is a Continuation in Part of our application Ser. No. 282,633, filed Aug. 21, 1972, now abandoned.

In making foundry moulds and cores the particles of the foundry sand used must be bound together. Both organic and inorganic binder compositions are known and compositions of both types are known which will cause setting at room temperature.

Typical of the organic binders that are used are resin condensates in oligomeric form of formaldehyde with one or more of furfurylalcohol, phenol and urea. Curing of such a condensate is brought about by mixing the condensate with an acidic catalyst in the presence of the sand.

It is desirable that the mould or core obtained upon curing of the sand-binder mixture should have as high strength as possible and that it should acquire high strength rapidly.

It is known that the strength of an organic resin bonded foundry mould or core can be improved by incorporating a silane in the binder composition. This is described in, for example, British Patent Specification No. 1,143,351, and it is also disclosed in U.S. Pat. Specifications Nos. 3,720,642 issued to Junger et al 13 March 1973, and No. 3,734,936 issued to Brown 22 May 1973.

In practice when carrying out the methods of any of these patents one will usually introduce both the acid and the condensate in aqueous form and so some water is necessarily present in the composition. However it is well accepted that the amount of water should be kept to a minimum since the inclusion of water weakens the product. Examination of the said patents shows that the patentees appreciated this and kept the water content to a minimum, and in particular did not add any water other than that which necesarily had to be included with the binder and catalyst. For instance in British Pat. Specification No. 1,143,351 and in U.S. Pat. Specification No. 3,720,642 the amount of water is minimised even below that which would normally be present in a resin condensate system as a result of distillation of the water from the resin, and it is clear that in each of the Examples containing silane and organic binder in each of these patents the amount of water would probably always be less than 0.2% and would certainly be less than 0.5%. As water contents are specified in Brown U.S. Pat. No. 3,734,936 it is possible to calculate the maximum amount of water that can be used in his compositions. The theoretical maximum is 0.5%, but in practice it is usually much less, and can be as low as 0.018%.

Thus the general state of knowledge on organic binders modified with silanes for use in foundry moulds is that the amount of water will be as low as possible and in particular below 0.5%.

A disadvantage of conventional organic bindersand compositions, or silane modified compositions, is that before setting they behave as a solid particulate mixture and so have to be rammed or otherwise mechanically forced into the core or mould box used in order to make the mixture conform to the desired shape and in order to ensure uniformity of structure throughout the mould or core. Ramming or otherwise mechanically forcing the mixtures into core or mould boxes is a troublesome and time-consuming business, particularly if the desired mould or core is large and/or of an intricate shape.

Liass has described in his U.S. Pat. No. 3,424,600 and in his British Pat. No. 1,085,651 how a fluid selfhardening mixture for making foundry cores and moulds can be formulated as a result of including foaming agent in the mixture. Thus the aqueous phase of the mixture takes the form of a foam such as to render the total mixture fluid so that it can be poured into the mould or core box instead of having to be rammed. Liass proposes that there should be "a low total moisture content (about up to 5 to 6%)" and in all his Examples makes a deliberate addition of water, additional to the amount of water necessarily introduced with the binder and catalyst. In most of his Examples the binder is aqueous sodium silicate, but organic binders are mentioned and in Example 13 a urea formaldehyde furfurol resin binder is used. Again water is deliberately added to the mixture, in an amount of 2%. Although the amount of water present in the binder and foaming agent is not specified at a conservative estimate this, together with the water in the catalyst, must bring the water content in the Example up to about 3%, and probably to a higher figure. Even with this value apparently Liass recognised that it did not have optimum fluidity as he recommended vibrating the mould when making a core of complicated configuration, and yet this would be unnecessary with a properly fluid mix.

Since it is fundamental to Liass that he should have a foamed aqueous phase in an amount sufficient to render the entire composition fluid, it must be assumed that water contents of the order of those used by Liass would be essential to the formation of an adequate liquid mixture.

The foamed systems described by Liass apparently were all intended to collapse on pouring into the mould. As a result the mix occupies less volume while it is still uncured and so is more dense and, on curing, stronger than would be the case if it kept its foamed structure until curing.

So far as I am aware, prior to the present invention the only fluid foundry processes that have been commercially successful are those using sodium silicate as a binder, the general experience of organic binders apparently having been that mixtures in accordance with the teachings of Liass are too weak to be commercially competitive with other available compositions.

It might have been thought that this weakness could be overcome simply by increasing the amount of binder over that proposed by Liass, but this is not satisfactory since increasing binder content results in increased amounts of gaseous pyrolysis products and these tend to cause blowholes in the castings.

A principal object of the invention is to provide a method of making foundry moulds or cores based on an organic binder and in which the composition before curing is fluid but which gives improved strength after curing. Another object is to provide such compositions having improved fluidity and another object is to provide methods of making compositions having improved fluidity.

According to the invention a foundry mould or core is made by a process comprising forming a fluid mixture comprising foundry sand and a foamed aqueous phase comprising resin condensate, foaming agent, acidic curing agent and silane, pouring the composition while fluid into a mould or core box and allowing the fluid composition to set. In the invention the total amount of water in the mixture is less than 2% by weight of the mixture but is more than the minimum necessary to cause foaming of the aqueous phase to render the mixture fluid, and the amount of silane is from 0.05 to 0.5% by weight based on the weight of silane and resin condensate, and the foamed aqueous phase retains its foamed structure until setting starts.

By the invention, one can make a mix of very good fluidity, so that it pours easily and conforms well to the shape of the mould, and that does not collapse before setting, so that it accurately retains the shape of the mould, and that yields a product on curing of surprisingly good mechanical properties. These are especially remarkable in view of the low density of the cured product, as a result of the foam persisting until setting. In particular the cured product has very satisfactory strength throughout and very high surface hardness and strength.

The resin condensates used are preferably furfuryl alcohol/formaldehyde, phenol/formaldehyde or urea/formaldehyde resin condensates but it can be advantageous for the binder compositon also to contain free furfuryl alcohol. The resin condensates are usually water-soluble and are normally available and used in the form of aqueous compositons, e.g. solutions, containing from 1 to 30% by weight of water. The aqueous resin condensate composition is usually used in an amount of 1 to 5% based on the weight of the foundry sand e.g. 0.75 to 4.5% resin solids, preferably at least 1.75%, more preferably at least 2%, resin solids.

The silane is best dissolved in the resin before the resin is mixed with the sand. Especially when the resin is not a urea formaldehyde resin, i.e. when it is a phenol- and/or furfuryl alcohol-formaldehyde resin, the silane is preferably mixed with the resin only just before the resin is mixed with the sand.

The silane must be one that will improve the strength of a composition containing the binder, some silanes being more suitable for use with some binders than others. In general the silane will be preferably of general formula $R'Si(OR)_3$ in which R' is a $C_2$-$C_6$ alkylene group bonded to an amino, epoxy, mercapto, hydroxy, hydroxy-$C_1$-$C_6$ alkylamino, amino-$C_1$-$C_6$ alkylamino, $C_2C_6$ alkenyl or $C_2$-$C_6$ alkenyl-carboxy group and the groups R may be the same or different and are selected from $C_1$-$C_6$ alkyl and $C_1$-$C_6$ alkoxy-substituted-$C_1$-$C_6$ alkyl. The amount of silane used is usually from 0.05 to 0.5%, preferably from 0.1 to 0.2% based on the total weight of aqueous resin condensate composition and silane.

Suitable curing agents for the resin condensates are well known, examples being 80 and 85% by weight phosphoric acid and 67% by weight p-toluene sulphonic acid. Also, sulphuric acid in various concentrations can be used as can mixtures of two or all of the three named acids. We have found that aqueous solutions containing both p-toluene sulphonic acid and sulphuric acid are very satisfactory. Preferred solutions of this type contain from 50 to 70% by weight of water and may include the foaming agent as well. The amount of curing agent used depends on the amount and nature of the resin condensate, on the desired setting time for the mixture of foundry sand and binder composition and on the nature of the curing agent itself. Usually the curing agent is used in an amount of 10% to 50% based on the weight of the aqueous resin condensate composition. In the case of curing agents containing relatively little water e.g. 80% phosphoric acid suitable amounts are usually 10 to 100%, preferably 50 to 75%, whereas curing agents of higher water content e.g. the solutions containing both p-toluene sulphonic acid and sulphuric acid and having 50 to 70% of water are normally used in amounts of 100 to 150%. The curing agent will normally be used in an amount in the range of 0.5 to 2.5% based on the weight of the foundry sand, or the amount of acid catalyst plus foaming agent should be 2 to 3%.

The amount of water used in the invention is critical to success. If too much is used, above 2%, the fluidity of the sand may be quite satisfactory but the final strength of the product will be wholly unsatisfactory. If too little is used, which in practice means if less than 1% is used, it will be impossible to make a fluid mixture since an appropriate foamed aqueous phase will not exist. Thus the amount of water should be above 1 but less than 2%, based on the total weight of the mixture, and best results seem to be achieved with water contents of 1.3 to 1.8%.

At first sight it might be thought that the invention is the inevitable result of merely combining the disclosures of, for instance, Liass U.S. Pat. No. 3,424,600 and Brown U.S. Pat. No. 3,734,936. However as explained above Liass necessarily uses large amounts of water, for instance at least 3% in the relevant Examples, while Brown necessarily uses low amounts of water, and in each instance the amount of water appears fundamental to that invention, and Liass had an unstable foam that collapses before setting. It is very surprising that by using the amount of water defined herein one can still obtain a foam, despite the fact that the amount is less than 66% and usually less than 50% of the amount specified by Liass, and it is also very surprising that satsfactory bond strength and very good surface hardness are obtained despite the facts that the amount of water is at least 200% and often 300% or more than the amount specified by Brown and that the foamed structure is retained until setting starts, so that the product is less dense and would be expected to be inherently weaker than the collapsed foam system of Liass.

Because the system is a foamed system the density of the final product is less than the density of a conventional rammed system, and so naturally the compression strength may be less than the strength of a comparable non-foamed system. However a remarkable fact about the invention is that despite having lower density and lower strenght compared with rammed systems the products have handleability and give castings at least as good as the rammed systems.

Additionally it has most surprisingly been found that not only is good bond strength obtained but that the increase in bond strength due to the silane is much greater than the increase in bond strength obtainable with the same amount of water in a non foamed system. It is wholly unpredictable that the increase in bond strength would be greater in a foamed system than in a non foamed system as a result of the inclusion of silane.

An additional advantage of the invention is that not only does the final product have high strength but the surface of the core or mould has even higher strength than the centre. Thus while the overall core or mould has good strength such that it can safely and easily be handled, the surface has such high strength that it contributes to a particularly high surface finish in the casting that is cast against it. Since the strength of a core or mould made from a non-foamed, rammed mixture is substantially uniform throughout this extra strength obtainable in the invention is particularly surprising, as well as being highly advantageous.

Foaming agent has to be included in the aqueous phase of the mixture to make it foamed and the mixture fluid, and the nature and amount of foaming agent affects the degree of fluidity of the composition at any particular time. Also the nature and amount of curing agent affects the rate of setting of the composition.

Naturally these factors should be so chosen that, whilst the composition sets in a desirable short time, it does not set so rapidly that the degree of fluidity of the composition is reduced so quickly that its ability to fill the mould or core box properly, including the finer details of the cavity, is impaired. The nature and amount of the curing agent and the foaming agent also influences the degree of porosity of the set moulds or cores. The fluid composition is nonpermeable as it behaves generally as a liquid but as the composition sets the foam bubbles break up so that after stripping the mould or core gradually develops permeability. If, contrary to the invention, the nature and amount of the curing agent and foaming agent are such that the foam has collapsed to a considerable extent before the composition starts setting the density (and strength) and permeability will be higher than if the foam does not collapse before setting of the composition, but arcuate filling of the mould is more difficult, since the volume of the composition decreases as the foam collapses.

It would be expected to be desirable or even necessary to collapse the foam before setting, so as to obtain increased density and therefore increased strength, but it is surprisingly found in the invention to be preferred to keep the low density structure and to prevent the foam collapsing before setting starts. Thus the foam persists at least until setting starts and the bubbles of the foam break as the composition sets. Thus in the invention the components of the mixture, and in particular the amount and nature of foaming agent, are such that the foam is stable i.e. the aqueous phase remains foamed and thus the composition remains fluid until setting starts. Thus the foam does not collapse upon pouring into the mould but instead survives for sufficient time for curing to set the composition in its expanded state and the bubbles of the foam break up as the composition sets. Thus preferably the compositon is stable against collapse of the foam for at least 30 minutes or one hour after pouring into the mould, by which time setting should have started.

As mentioned, the mixture must contain sufficient water in order for foaming of the aqueous phase to render the mixture fluid and in practice the amount of water is from 1 to 2%. Water is usually introduced both in the resin condensate and curing agent. Preferably no additional water is added.

The foaming agent used must be one that will give the desired foam stability and a wide variety of foaming agents will give some degree of foaming of the aqueous phase and therefore some degree of fluidity. Typical foaming agents are selected from alkali metal organic sulphates and sulphonates. Usually the foaming agent is used in an amount of 0.1 to 0.5% dry weight beased on the weight of foundry sand. In general rather more foaming agent is needed when the resin is a phenolic resin than when it is, for instance, a urea foamldehyde and/or furfuryl alcohol resin.

Included amongst surface active agents that can be used to make a foamed aqueous phase and thus a composition having some degree of fluidity are triethanolamine alkyl sulphate, fatty alcohol ethoxylates, sodium dodecyl and other alkyl benzene sulphonates, nonyl phenol ethylene oxide condensates, certain fatty amido alkyl betaines, such as that sold under the trade name "Lorapon AMB13" which is a "cocoamide" alkyl betaine, and certain substituted imidazolines such as those sold under the trade names "Crodateric C" and "Crodateric L", and sodium lauryl ether sulphates. In practice these last three classes of materials are best from the point of view of making a stable foam that persists until setting starts and, of these three, the last gives much the strongest cured product. Thus best results are obtainable when using a sodium lauryl ether sulphate.

Suitable sodium lauryl ether sulphates are those obtained by ethoxylating lauryl alcohol with, for instance a chain of three ethoxy groups and sulphating the product. Examples of such materials are those sold by Lankro Chemicals under the trade name "Perlankrol ESD" and those sold by Albright & Wilson Limited under the trade names "Empimin KSN 27" and "Empimin KSN 60". They are all an industrial grade of sodium lauryl ether sulphate based on a narrow cut lauryl alcohol, "Perlankrol ESD" and "Empimin KSN 27" being 27% aqueous solutions and "Empimin 60" being a 60% aqueous solution containing about 10% ethanol.

Although as mentioned above various foaming agents can be used to make a foamed aqueous system and therefore a fluid mixture, it is found that a fluid mixture having immensely superior properties to all the other fluid mixtures is obtained if the foaming agent is a sodium lauryl ether sulphate. As is well known this class of foaming agents includes members that can vary slightly from one to another depending upon the breadth of cut of the "lauryl" radical and according to the degree of etherification, and it is possible that some may be inferior to others. On the whole, however, exceedingly good results are obtained with sodium lauryl ether sulphates as the foaming agent. Thus whereas the foamed system of Example 13 of Liass U.S. Specification No. 3,424,600 or any other foamed systems with organic resins that I have made using other surface active agents, such as alkylbenzene sulphonates and alkyl sulphates, give a fluid mixture that is rather nonuniform in its properties and of poor stability, such that the foam tends to break and the mixture becomes nonfluid upon pouring into the mould or quite quickly thereafter, when the preferred sodium lauryl ether sulphate foaming agents are used it is easily possible quickly to make a foam such that the mixture has exceedingly high and uniform fluidity, flows easily into all corners of the mould and the foam is stable, that is to say there is no permeability for at least half an hour and often longer, by which time setting will have started.

The mixture of foundry sand and binder composition can be made by adding and mixing the components in various orders but in one simple method the water, curing agent and foaming agent are added to the foundry sand and these components are mixed together so as to cause foaming and than the aqueous resin condensate composition and silane are added and mixed in.

It is convenient to use an aqueous composition containing both the curing agent and the foaming agent and this composition may contain all the water necessary in additon to that in the aqueous resin condensate composition. Preferred compositions of this type contain 5 to 20% by weight of foaming agent e.g. Albright and Wilson's Empimin KSN 27, up to 50% by weight of p-toluene sulphonic acid (67% aqueous solution), up to 50% by weight of phosphoric acid (80% aqueous solution) and up to 85% of sulphuric acid (31.5% aqueous solution). A particularly preferred composition contains 9% of Empimin KSN 27, 31% of the p-toluene sulphonic acid and 60 1 % of the sulphuric acid.

It is well known that the standard way of mixing a traditional (non-fluid) foundry mix based on acid catalysed resins is to disperse the acid catalyst uniformly through the sand by thorough mixing and then to add the binder. The reason for this is that if one adds the binder before mixing the acid catalyst into the mixture localised curing of the binder starts immediately the acid contacts the mixture and so non-uniform curing occurs. As mentioned above, the normal way of making the mixtures of the invention is to mix the sand with the curing agent and to add the binder and silane later, and most preferably to mix the sand with the foaming agent and the curing agent and then to add the binder and silane. Any different order of mixing would appear to be contraindicated for the traditional reasons that have rendered it necessary to adopt this order in non-foamed systems.

Despite this it has now surprisingly been found that better flidity is obtained when the catalyst is added to a preformed fluid mixture of sand, binder and foaming agent than when the catalyst is included with the sand before the binder is added. Accordingly a preferred method according to the invention comprises forming a fluid mixture of foaming agent, resin condensate binder and sand and then mixing into this fluid mixture the acidic curing agent for the binder, pouring the mixture while fluid into a mould or core box and allowing it to set. This method gives particularly good results when the foaming agent is sodium lauryl ether sulphate and when the mixture includes silane. The amounts of catalyst, foaming agent, binder and silane may all be as discussed above, the water contents being particularly important, and materials for use as the binder and catalyst and silane may all be as discussed above.

Each of the various aspects of the invention, namely the choise of the right water content, the choice of the preferred surfactant and the choice of the order of mixing individually, and particularly collectively, contribute to a system that is many orders of magnitude better than any other resin bonded system of which I am aware. Not only does the system permit one for the first time to obtain low viscosity foundry fluid sand and very satisfactory resin bonded products from a liquid, foamed, mixture but one also has a liquid mixture that can conform particularly accurately to the mould merely upon pouring, thus the mould or core box should be immobile and ramming, vibration or other techniques for consolidating the mix before setting are both unnecessary and harmful.

The following are some Examples that illustrate the invention and compare it with the prior art. In some of these viscosity is recorded in seconds. In each instance the viscosity is measured by a viscometer which consists of mild steel vessel with an opening at the bottom. The shape of the vessel is a cylinder of 170 mm diameter 180 mm high finishing at the bottom with a cone 65 mm high and cut for the outlet. The diameter of the outlet is 45 mm and it is closed by a shutter connected electrically with a stop watch. Inside the cylinder there is a stirrer with 8 blades round the vertical shaft and which rotates at 85 revs per minute.

The mixer serves to prepare a mix of 4000 grammes of fluid sand. When ready (after 4½ mins of mixing) the shutter is opened manually and sets the stop watch in motion. The sand drops into a tared container. Its bottom is placed 350 mm below the opening of the mixer. The container is placed on a scale having a dish which, when it receives a weight of 2 kg of sand, tilts and electrically stops the stop watch.

The viscosity figure is the time in seconds during which 2000 g of sand drops from the mixer. The lower the figure the lower the viscosity, the "thinner" is the fluid sand.

EXAMPLE 1 (comparative)

1 Part by weight of water, 1.75 parts by weight of 80% phosphoric acid and 0.25 parts by weight of a foaming agent were mixed with 100 parts by weight of foundry sand, the mixing being such as to cause foaming of the aqueous phase. The foaming agent used was sodium lauryl ether sulphate available from Albright and Wilson Limited, Marchon Division, under the name Empimin KSN 60. 3 Parts by weight of an aqueous resin condensate composition were then mixed into the mixture obtained above. The aqueous resin condensate composition had a water content of 20% by weight and consisted of equal amounts of an aqueous urea/formaldehyde resin oligomer composition and furfuryl alcohol. The total water content was therefore about 1.95 parts.

The mixture obtained as described above was poured into a mould and allowed to set. After 24 hours the compression strength of the sample was measured and found to be 110 kg/sq. in.

EXAMPLE 2

The procedure of Example 1 above was repeated except that in the aqueous resin condensate composition 0.30% by weight of the furfuryl alcohol was replaced by γ-amino propyl, triethoxy silane, a silane available from Union Carbide under the designation A1100. After the final mixture had been in the mould for 24 hours the compression strength of the sample was measured and found to be 193 kg/sq.in., a 75% increase in compression strength compared with that of the sample obtained in Example 1. The sample made by Example 2 had a firm, non-friable surface.

In each of Examples 1 and 2 the foamed structure persisted until setting started, with the result that low density products that conformed accurately to the shape of the mould were obtained.

EXAMPLE 3 (comparative)

The process of Example 1 was repeated but in the absence of a foaming agent and added water (and thus the initial mixture had a water content of 0.95% and was not foamed) and using 2 parts by weight of aqueous resin condensate composition and 1 part by weight of 80% phosphoric acid. The compression strength was recorded.

EXAMPLE 4 (comparative)

The process of Example 2 was repeated but in the absence of a foaming agent and added water (and thus the initial mixture was not foamed) and using 2 parts by weight of aqueous resin condensate composition and 1 part by weight of 80% phosphoric acid with the silane. The compression strength was recorded.

It was found that although the product of Example 4 had a higher compression strength than the product of Example 3 the increase was only 43%. Thus in the non-foamed systems of Examples 3 and 4 the inclusion of silane in the non-foamed system containing 0.95% water resulted in an increase in compression strength of only 43% while in the foamed system containing 1.95% water the increase was 75%.

The density of the sampls made by Examples 1 and 2 was approximately 25% lower than that of the samples made by Examples 3 and 4 where no foaming agent was used.

EXAMPLE 5

A series of processes generally similar to Examples 1 to 4 were conducted using, as the binder, 1.75% (based on the sand) of a mixture of 45% phenol formaldehyde resin condensate in oligomeric form, 45% free furfuryl alcohol and 10% water and using as catalyst a mixture of p-toluene sulphonic acid and sulphuric acid. In each instance the sand was mixed with the acid catalyst first and then the binder and silane A1100 were added. When foaming agent was present it was introduced as a premix with the acid catalyst. The foaming agent used was an aqueous solution of sodium lauryl ether sulphate, A being "Perlankrol" ESD and B being "Empimin" KSN60. Two catalyst mixtures were used. C contained, on a non-aqueous basis 83% paratoluene sulphonic acid and 17% sulphuric acid while the contents of these acids in D were 96% and 4%. The composition providing catalyst C had a total water content of from 33 to 55%, depending on whether the foaming agent was in the composition, and was added in an amount of about 2.5%.

In Table I below are given the amounts of silane (as a percentage of the total binder), the solids weight of foaming agent and catalyst (as percentage of sand), the viscosity in seconds and the compression strength in pounds per square inch after 24 hours.

Table I

| Test | Silane | Foaming Agent | Catalyst | Added Water | Total Water | Viscosity | Strength |
|---|---|---|---|---|---|---|---|
| 5A | — | — | 1C | — | 1.4 | not fluid | 468 |
| 5B | 0.2 | — | 1C | — | 1.4 | not fluid | 785 |
| 5C | — | — | 0.4D | — | 0.38 | not fluid | 655 |
| 5D | 0.2 | — | 0,4D | — | 0.38 | not fluid | 968 |
| 5E | — | 0.27A | 1C | — | 1.4 | 18 | 140 |
| 5F | 0.2 | 0.27A | 1C | — | 1.4 | 16¾ | 290 |
| 5G | — | 0.27A | 1C | 0.5 | 1.9 | 14½ | 45 |
| 5H | 0.2 | 0.27A | 1C | 0.5 | 1.9 | 13¾ | 170 |
| 5I | — | 0.27A | 1C | 1.0 | 2.4 | 12 | too weak to test |
| 5J | 0.2 | 0.27A | 1C | 1.0 | 2.4 | 11½ | 53 |
| 5K | 1.0 | 0.27A | 1C | 1.0 | 2.4 | 11½ | 120 |
| 5L | 0.2 | 0.16B | 1C | 0.55 | 1.4 | 17¾ | 250 |
| 5M | 0.2 | 0.16B | 1C | — | 0.85 | not fluid | — |
| 5N | 0.2 | 0.16B | 1C | 0.15 | 1.0 | 33¼ | — |
| 5O | 0.2 | 0.16B | 1C | 0.3 | 1.15 | 24 | — |
| 5P | 0.2 | 0.16B | 1C | 0.45 | 1.3 | 21 | — |

Tests 5A to 5D were all non-fluid rammed sands showing good strength, the strength being increased by addition of silane and by reduction of water from 1.4% to 0.38%.

Comparison of tests 5E and 5F show that the inclusion of silane more than doubles the strength in a fluid system, whereas in the rammed systems of 5A and 5B it gives an increase of less than 50%. Although the strength of 5F was less than that of the rammed systems the surface was particularly hard and the product could be handled and used as satisfactorily and was much lighter than the rammed system.

Tests 5I and 5J show that when more than 2% water is used very weak products are obtained even in the presence of silane although higher, but still very poor, strength can be obtained if a large amount of silane is used (5K). Whereas 5E to 5L and 5N to 5P were all stable foams of which the bubbles did not break until setting occurred, no foam could be made in 5M since the water content was too low. In this a foam was formed upon mixing the sand, acid and foaming agent together but it collapsed when the binder was added. With slightly increased water content (in 5N) a stable foam was formed although it was more viscous than is preferred, and good foams are obtained at higher water contents (5O and 5P).

EXAMPLE 6

To demonstrate the effect of differing foaming agents a series of compositions was made in accordance with the procedure of Example 2 but using a wide range of different foaming agents. Of the large number tested only seven gave a product that visually appeared to have good stability and fluidity and which could be measured to have low viscosity, namely Perlankrol ESD, Empimin KSN 27 and Empimin KSN 60 (all sodium lauryl ether sulphates), Crodateric C and Crodateric L (substituted imidazolenes), and Lorapon AMB13 (cocoamido alkyl betaine) and Empicol ESB3 (sodium ethoxylated lauryl alcohol). However when the compression strength of the final core was measured it was fund that the products made from the last four had much lower compression strengths than those made from the first three, the sodium lauryl ether sulphates. All the other surface active agents tested were either wholly immiscible with the acid catalyst and binder or gave a mixture that had higher viscosity and/or a less pleasing visual appearance and/or no foam or an unstable foam than the seven mentioned above. Amongst the many surfactants tested and all discarded as being less satisfactory than those mentioned above were Eltasol SX30 (sodium xylene sulphonate), Empicol TLR (triethanolaminalkyl sulphate), Nansa 5560 (sodium alkyl benzene sulphonate) and Nansa MA30 (sodium dodecyl benzene sulphonate with nonionic addition), Nansa HSA (oleum sulphonated alkylbenzene sulphonic acid), Teepol (sodium lauryl sulphate), Pentrone ON (2-ethylhexyl sulphate sodium salt), Lithapol NX (nonyl phenol ethylene oxide condensate), Dispersol T (disodium salt of methylene dinaphthalene sulphonic acid) and various others. Example 7 compares the results obtained using the traditional and new orders of mixing and Example 8 additionally includes results obtained when carrying out processes similar to Examples 12 to 14 (tests 8A, 8B and 8 C respectively) of British Patent Specification No. 1,430,841, which are the only disclosures of which we are aware which show the new order of mixing applied to a fluid system, and Example 9 reproduces Examples 13 and 14. As will be apparent in each of tests 8A, 8B and 8C and Example 9 the order of the invention (acid added last) resulted in the formation of an unstable foam. This is only to be expected as it is clear that Specification No. 1,430,841 is concerned solely with unstable foams. Further although under the particular conditions used in the tests no foam was made with the conventional order of mixing in test 8A, in tests 8B and 8C the new order of mixing resulted in worse fluidity than the conventional order of mixing. In test 8A at least the fluidity of the system with the new order of mixing was so low as to necessitate vibration of the mould. The preferred method of the invention, 8F, gave by far the best results.

EXAMPLE 7

Sand, binder, foaming agent and catalyst are mixed in the amounts and order given below in Table 1 in the vessel described above and the viscosity of the mix was measured as described above. The binder was a phenol formaldehyde furfuryl alcohol binder containing 10% water and 0.2% silane (the product sold as A1100), the foaming agent was the 27% solution of sodium lauryl ether sulphate sold under the trade name "Perlankrol ESD" and the catalyst was a composition having 33.13% water content and formed from 83.34% paratoluene sulphonic acid, 14.32% of 77% sulphuric acid and 2.34% water. The total amount of water in each mix was about 1.4% based on the weight of sand.

In tests B and C the foaming agent and catalyst were first mixed with the sand thoroughly by a paddle mixer for 2½ minutes, by which time the aqueous phase has foamed and the mixture fluid, and the binder and silane were then added and mixed with the paddle mixer for another minute, whereupon the viscosity was measured and the mixture was poured into a mould or core and left to set. Tests A and B were carried out in the same manner except that the binder, silane and foaming agent were mixed with the sand in the initial 2½ minute mixing period and the catalyst was added afterwards, for the final minute mixing. The results obtained are shown in Table II.

Table II

| Test | Sand g | Binder (B) g | Binder (B) % | Foam Agent (F) g | Foam Agent (F) % | Catalyst (C) g | Catalyst (C) % | Order of Addition | Viscosity |
|---|---|---|---|---|---|---|---|---|---|
| A | 4000 | 71.5 | 1.7875 | 38.5 | 0.9625 | 60 | 1.5 | B+F;C | 13½ |
| B | 4000 | 71.5 | 1.7875 | 38.5 | 0.9625 | 60 | 1.5 | F+C;B | 26 |
| C | 4000 | 70 | 1.75 | 36 | 0.9 | 60 | 1.5 | F+C;B | 28 |
| D | 4000 | 70 | 1.75 | 36 | 0.9 | 60 | 1.5 | B+F;C | 15 |

Comparison of Test A with Test B and of Test D with Test C shows that by adding the catalyst at the end, instead of at the beginning, the viscosity is almost halved, and this is an indication of the great increase in fluidity of the composition.

In all four tests the composition was poured into a mould and upon curing in the mould a product having good compression strength and having very high surface finish but having low density was obtained.

EXAMPLE 8

4 kg of Chelford 50 sand were mixed with the binder used in Example 1 and with foaming agent, and acid in the amounts and order specified in Table III in the vessel described above and the viscosity of the mix was measured as described above. When the acid (C) was mixed with the sand and foaming agent (F) before the binder (B), C and F were introduced together by adding 2½%, based on sand, of a mixture of 40% of a 27% solids solution of foaming agent, 50% of 67% solids paratoluene sulphonic acid, 8.6% of 77% sulphuric acid and 1.4% water, and 1.75% of the binder added after 2½ minutes and the product mixed for a further 1½ minutes. When the binder and foaming agent were added first 70 g (1.75%) of binder and 40 g (1%) of the surfactant were added and after 2½ minutes mixing 60 g (1½%) of the same acid mixture was added and the mix mixed for a further 1½ minutes.

Table III

| Test | Foaming Agent | First Addition | Second Addition | Viscosity of mix (seconds) | Stability of foam |
|---|---|---|---|---|---|
| 8A | Cordanol SBL 35 (fatty acid alkanolamide sulphosuccinate) | B + F | C | 77 | unstable |
| | | C + F | B | not fluid | — |
| 8B | Armac C (acetate salt of $C_{6-18}$ coconut amine) | B + F | C | 35 | unstable |
| | | C + F | B | 15½ | more stable |
| 8C | Armeen 12D (97% lauryl amine) | B + F | C | 19 | unstable |
| | | C + F | B | 16 | more stable |
| 8D | Lorapon AM B13 (cocamido alkyl betaine) | B + F | C | 16½ | stable |
| | | C + F | B | 20½ | stable |
| 8E | Empicol ES B3 (sodium ethoxylated lauryl alcohol) | B + F | C | 48 | stable |
| | | C + F | B | 58 | less stable |
| 8F | Empimin KSN 27 (sodium lauryl ether sulphate) | B + F | C | 13½ | stable |
| | | C + F | B | 18½ | stable |

After pouring and curing, the product of 8F had much the best strength.

EXAMPLE 9 (comparison)

Two mixes were formed using the same technique as above from the recipe 50 parts of sand
1 part of binder (45% ureformaldehyde resin plus 55% furfuryl alcohol)
1 part of catalyst (18% phosphoric acid, 18% sulphuric acid, 64% water)
0.05 lauryl amine acetate (Armac C)
0.05 water In mix A the binder with foaming agent were mixed first and then the acids were added. Viscosity of this sand was 39½ secs. In mix B the acids with the foaming agent were added first and mixed. To this the binder was added. The viscosity was 31½ secs.

Similar types of results were obtained when instead of lauryl amine acetate, 97% lauryl amine was used (Armeen 12d). In mix C the binder with the foaming agent were added first and the acids last and the viscosity was 31½ secs. In mix D the acids and foaming agent were mixed together first and the binder last and the viscosity was 26 seconds.

Thus the viscosity was worse when the acid was added last than when it was added first.

We claim:

1. A method of making a foundry mold or core comprising forming a fluid mixture comprising foundry sand and a foamed aqueous phase comprising resin condensate, said resin condensate being an oligomeric form of formaldehyde with one or more of furfuryl alcohol phenol and urea, surfactant foaming agent, acidic curing agent and a silane, said silane having the general formula $R'Si(OR)_3$ in which R' is a $C_2$-$C_6$ alkylene group bonded to an amino, epoxy, mercapto, hydroxy, hydroxy-$C_1$-$C_6$ alkylamino, amino-$C_1$-$C_6$ alkylamino, $C_2$-$C_6$ alkenyl or $C_2$-$C_6$ alkenyl-carboxy group and the groups R may be the same or different and are selected from $C_1$-$C_6$ alkyl and $C_1$-$C_6$ alkoxy-substituted-$C_1$-$C_6$ alkyl, pouring the composition while fluid into a mould or core box which is immobile, and allowing the fluid composition to set without vibration of the mould or core box or ramming of the fluid mixture or other consolidation techniques, in which process the amount of silane is from 0.05 to 0.5% by weight based on the weight of silane and resin condensate, and the total amount of water in the mixture is less than 2% by weight of the mixture but is more than the minimum necessary to cause foaming of the aqueous phase to render the mixture fluid and in which the foamed aqueous phase retains its foamed structure until setting starts.

2. A method according to claim 1 in which the total amount of water in the mixture is from 1 to 2%.

3. A method according to claim 1 in which the fluid mixture is formed by combining the sand, aqueous foaming agent, aqueous catalyst and 1 to 5% of an aqueous resin condensate containing 1 to 30% by weight water, and no additional water.

4. A method according to claim 3 in which the catalyst is an aqueous solution comprising one or more of phosphoric acid, p-toluene sulphonic acid and sulphuric acid.

5. A method according to claim 3 in which the curing agent is an aqueous solution comprising sulphuric acid and p-toluene sulphonic acid.

6. A method according to claim 1 in which the foaming agent is sodium lauryl ether sulphate.

7. A method of making a foundry mould or core comprising forming a fluid mixture comprising foundry sand and a foamed aqueous phase comprising 1 to 5% of an aqueous resin condensate containing 1 to 30% water and an oligomeric form of formaldehyde with one or more of furfuryl alcohol, phenol and urea, 0.05 to 0.5% by weight based on the weight of the aqueous resin condensate of a silane which has the general formula $R'Si(OR)_3$ in which R' is a $C_2$-$C_6$ alkylene group bonded to an amino, epoxy, mercapto, hydroxy, hydroxy-$C_1$-$C_6$ alkylamino, amino-$C_1$-$C_6$ alkylamino, $C_2$-$C_6$ alkylene or $C_2$-$C_6$ alkenyl-carboxy group and the groups R may be the same or different and are selected from $C_1$-$C_6$ alkyl and $C_1$-$C_6$ alkoxy-substituted-$C_1$-$C_6$ alkyl, and sufficient sodium lauryl ether sulphate to render the foam stable, in which the fluid mixture has a total water content of 1 to 2% and is poured into a mould or core box and allowed to set without vibration, ramming or other consolidation technique, wherein the foamed phase retains its foamed structure until setting starts.

8. A foundry mould or core made by a method according to claim 1.

9. A method according to claim 1 in which the total amount of water in the mixture is from 1.3 to 1.8%.

* * * * *